US010969193B2

(12) United States Patent
Walter

(10) Patent No.: US 10,969,193 B2
(45) Date of Patent: Apr. 6, 2021

(54) WATER GUN

(71) Applicant: Spyra GmbH, Munich (DE)

(72) Inventor: Sebastian Walter, Alfter (DE)

(73) Assignee: SPYRA GMBH

( * ) Notice: Subject to any disclaimer, the term of this patent is extended or adjusted under 35 U.S.C. 154(b) by 0 days.

(21) Appl. No.: 16/688,193

(22) Filed: Nov. 19, 2019

(65) Prior Publication Data

US 2020/0080816 A1 Mar. 12, 2020

Related U.S. Application Data

(63) Continuation of application No. PCT/EP2018/063790, filed on May 25, 2018.

(30) Foreign Application Priority Data

May 26, 2017 (DE) ..... 102017208922.9

(51) Int. Cl.
*F41B 9/00* (2006.01)

(52) U.S. Cl.
CPC ..... *F41B 9/0071* (2013.01); *F41B 9/0075* (2013.01); *F41B 9/0009* (2013.01)

(58) Field of Classification Search
CPC .... F41B 9/0071; F41B 9/0075; F41B 9/0009; F41B 9/00; F41B 9/0006; F41B 9/0003; F41B 9/0015
USPC ..... 222/79, 320, 373, 380; 239/211, 583; 124/77
See application file for complete search history.

(56) References Cited

U.S. PATENT DOCUMENTS

| | | | | |
|---|---|---|---|---|
| 3,042,262 | A | 7/1962 | Powell | |
| 3,091,370 | A | 5/1963 | Weiner | |
| 3,374,708 | A * | 3/1968 | Wall | F41H 13/0037 89/1.11 |
| 4,022,350 | A | 5/1977 | Amron | |
| 4,058,256 | A * | 11/1977 | Hobson | A62C 27/00 239/101 |
| 4,360,132 | A * | 11/1982 | Vilagi | B05B 9/01 222/504 |
| 4,706,848 | A | 11/1987 | A'Ndrade | |
| 4,743,030 | A | 5/1988 | Auer | |
| 4,757,946 | A | 7/1988 | Johnson | |
| 4,854,480 | A | 8/1989 | Shindo | |
| 5,052,587 | A | 10/1991 | Graves | |
| 5,094,399 | A * | 3/1992 | Zaber | B05B 9/002 239/135 |

(Continued)

FOREIGN PATENT DOCUMENTS

| | | | |
|---|---|---|---|
| CN | 1039480 | A | 2/1990 |
| DE | 2916726 | A1 | 9/2016 |

(Continued)

*Primary Examiner* — Benjamin R Shaw
(74) *Attorney, Agent, or Firm* — Yakov Sidorin; Quarles & Brady LLP

(57) ABSTRACT

The invention relates to a water gun, in particular to a toy water gun comprising a supply line, which is adapted to supply a pressurized liquid from a source, a nozzle arrangement for ejecting the liquid to the environment as well as a valve for controlling a flow of the liquid in a direction from the supply line to the nozzle arrangement. The water gun additionally includes a flow-smoothing device, with the valve arranged behind the flow-smoothing device with respect to the flow direction.

16 Claims, 1 Drawing Sheet

(56) References Cited

U.S. PATENT DOCUMENTS 5,303,848 A * 4/1994 D'Andrade ..... F41B 9/0018 222/397
5,339,987 A * 8/1994 D'Andrade ..... F41B 9/0071 222/79
5,485,869 A * 1/1996 Haynes ..... F15B 13/0402 137/625.65
5,586,688 A 12/1996 Johnson
5,779,099 A 7/1998 D'Andrade
5,799,827 A * 9/1998 D'Andrade ..... B05B 1/34 222/79
5,875,927 A * 3/1999 D'Andrade ..... F41B 9/0012 222/183
6,138,871 A 10/2000 D'Andrade
6,345,732 B1 * 2/2002 Zimmerman ..... F41B 9/0018 222/79
6,364,219 B1 * 4/2002 Zimmerman ..... B05B 1/1654 222/79
2001/0040171 A1 * 11/2001 Crawford ..... F41B 9/0012 222/79
2004/0206771 A1 10/2004 Junkel
2005/0035148 A1 2/2005 Zimmerman
2005/0183708 A1 8/2005 Eddins
2009/0117822 A1 5/2009 Coffey
2009/0237857 A1 * 9/2009 Kao ..... F41B 9/0021 361/232
2016/0265868 A1 9/2016 Forsythe

FOREIGN PATENT DOCUMENTS

EP 0706414 B1 12/2001
EP 0914183 B1 8/2005
WO 95/00220 A1 1/1995
WO 98/29175 A1 7/1998
WO 03/016158 A1 2/2003
WO 2004/007289 A1 1/2004

* cited by examiner

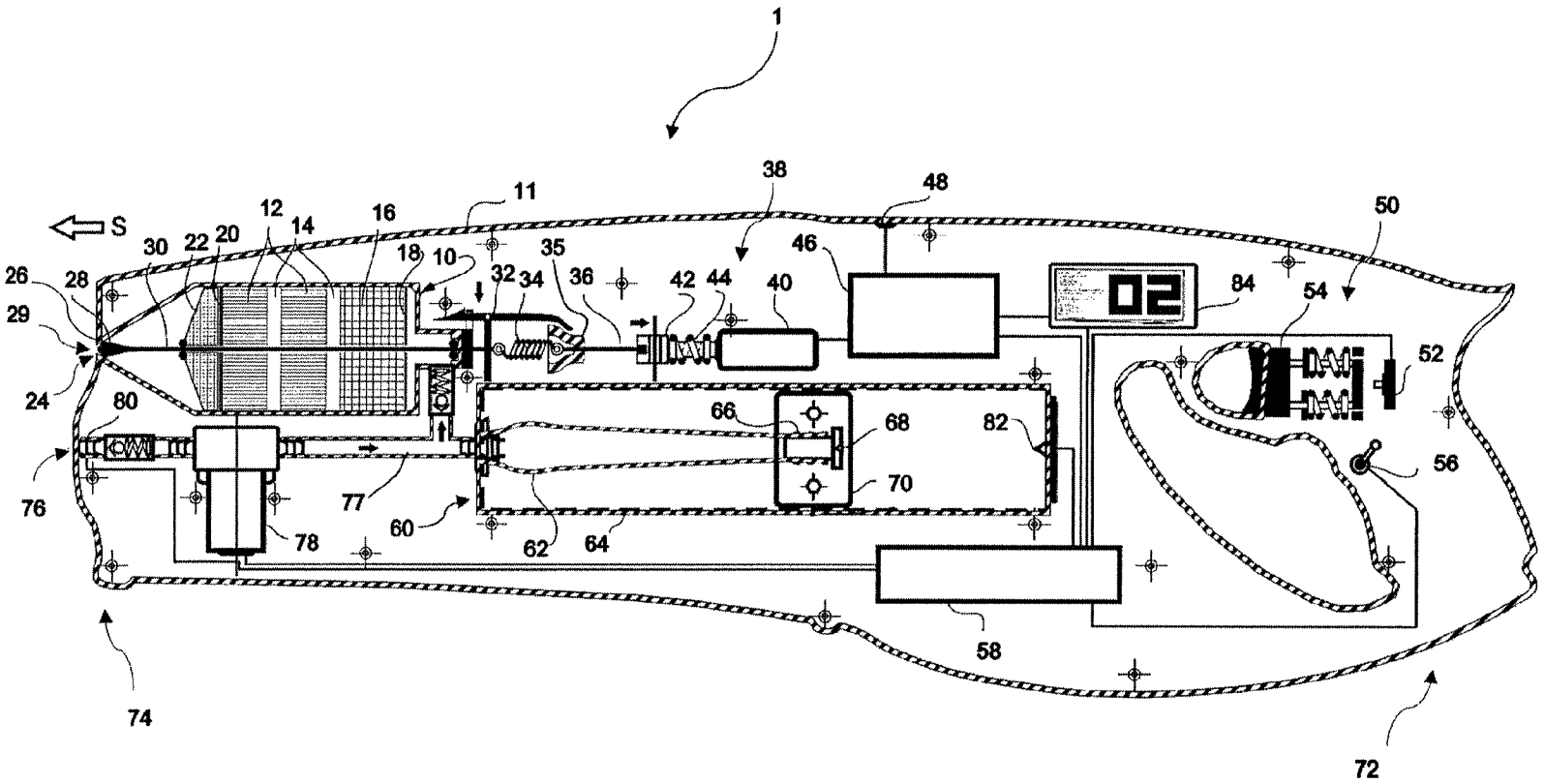
1
10
11
12
14
16
18
20
22
24
26
28
29
30
32
34
35
36
38
40
42
44
46
48
50
52
54
56
58
60
62
64
66
68
70
72
74
76
77
78
80
82
84
S

WATER GUN

CROSS-REFERENCE TO RELATED APPLICATIONS

This application is a continuation of the pending International Application No. PCT/EP2018/063790 filed on 25 May 2018, which designates the United States and claims priority from German Application No. 102017208922.9 filed on 26 May 2017. The disclosure of each of the above-identified applications is incorporated herein by reference.

BACKGROUND OF THE INVENTION

1. Field of the Invention

The invention relates to a water gun, in particular to a toy water gun comprising a supply line, which is adapted to supply a pressurized liquid from a source, a nozzle arrangement for ejecting the liquid to the environment as well as a valve for controlling a flow of the liquid in a direction from the supply line to the nozzle arrangement.

2. Description of Relevant Art

Water guns as known from the prior art are conventionally used during leisure activities in particular during joint activities of a plurality of persons. Conventionally said water guns are dimensioned such that they can be hand-held by a using person and are adapted for a directed ejecting of a liquid (e.g. water, colorized water etc.) in particular for wetting an object or another person.

Above-mentioned implementations of water guns are disadvantageous in that they have an operational range that is comparatively low in conjunction with limited target accuracy. Furthermore, conventional water guns may be difficult to handle and often do note deliver a realistic playing experience. These disadvantages lead to a significant limitation of pleasure being perceived by the users of said water guns.

The present invention has been made taking into account all of the above. It is an object of the invention to provide a water gun that solves the above-mentioned problems as well as causes increase of pleasure experienced by the user.

SUMMARY OF THE INVENTION

According to a first aspect of the present invention, the above-mentioned object is achieved by a water gun that includes at least one of: a storage device for storing pressurized liquid, a handle portion for gripping the water gun, a nozzle portion facing away from the handle portion with a nozzle arrangement for ejecting the liquid, and a pump device for supplying liquid from outside the water gun into the storage device via a liquid inlet of the water gun. The liquid inlet is arranged in the nozzle portion or adjacent to the nozzle portion. In contrast to water guns as known from the prior art the liquid inlet of the water gun is not arranged in proximity to the storage device or a handle portion but in proximity of the nozzle portion. In addition a filling procedure of the storage device can be realized by a pump device, which supplies liquid from outside the water gun via the liquid inlet into the storage device such that the water gun can be hand held by a user in a manner ready to fire during the entire filling process. Thus, the further object is achieved, to provide a water gun having a filling process which is particularly comfortable as well as extra fast.

According to a preferred embodiment, the pump device is an electrical pump device. Thus, the filling process may be carried out in a particularly comfortable manner without any manual pump operation by the user of the water gun, since the electrical pump device is adapted to intake liquid from outside the water gun and to put this liquid under pressure, i.e. to store the pressurized liquid in a liquid reservoir.

Preferably, the water gun may further include a sensor arranged in the nozzle portion, which sensor is configured to detect an activation condition of the pump device and to subsequently activate the pump device for filling the storage device. Due to the presence of an additional sensor it is possible to automatically activate the filling process such that a further simplification of the filling process is provided.

In particular, the sensor may include a liquid sensor, preferably a float, which is adapted to detect whether or not the nozzle portion is in contact with a liquid. Due to a detection of an immersing of the liquid sensor into liquid the filling process can be started automatically when the nozzle portion is immersed into a reservoir of liquid, for example a container or bucket filled with liquid.

The liquid inlet may include a filter, preferably a sieve. In order to prevent the absorption of foreign matter during the filling process, a sieve is arranged at the liquid inlet to ensure a failure-free function of the water gun.

According to a second aspect of the present invention, the above mentioned object is achieved by a water gun that includes at least one of: a supply line, which is adapted to supply pressurized liquid from a source, a nozzle arrangement for ejecting the liquid to the environment, and a valve for controlling the flow of the pressurized liquid in a flow direction (or direction of a flow) from the supply line to the nozzle arrangement. The valve includes a valve seat and a valve body attachable to the valve seat in a sealing manner. The valve body is translationally displaceable relative to the valve seat, i.e. the valve body is supported movably. For example, a plain bearing may be configured to enable a translation of the valve body at least substantially along the flow direction of the liquid. The valve body is driven by an electromechanical actuator. In order to displace the valve body in a translational manner according to the present invention the actuator is configured to displace (in one case—translationally) the valve body of the valve not due to a force being generated by the user of the water gun but due to a force being generated by the actuator. In this context, the actuator may be any kind of a drive, which is configured to displace the valve body in a translational manner. The drive may be in particular an electrical powered drive configured to shift the valve body parallel to the flow direction. Accordingly, the further goal is achieved to provide a water gun having an enhanced usability because the user doesn't have to provide a force, for example with her/his fingers, to open the valve. The force generated by the drive may be transmitted for example via a rod assembly to the valve body, i.e. the drive may be connected via a rod assembly to the valve body. In addition, a more precise control of ejecting characteristics of the water gun is obtained.

The valve body may have a shape elongated in the flow direction, i.e. a dimension of the valve body in the flow direction exceeds its dimension(s) along an axis that is perpendicular to the flow direction. In particular, the shape of the valve body may be an ellipsoidal shape or torpedo-like shape. In this context, the flow direction is the direction in which the liquid is ejected out of the water gun. Since the valve body has a shape elongated in the flow direction, the pressurized liquid will pass the valve (i.e. flow) around the valve body in a manner that will not cause any additional unsmoothing respectively any additional turbulence within the flow of the liquid being ejected out of the water gun. As a result, an enlarged range as well as an improved target accuracy of the water gun can be achieved.

According to a further embodiment of the present invention, the water gun may include a trigger device, which is configured to control the actuator. By way of controlling the actuator via a trigger device it is possible for the user to control whether or not liquid is ejected out of the water gun during use. In particular, with the present embodiment the trigger device is structured to control the movement of the actuator while being mechanically decoupled from the trigger device. For example, even if the trigger device is operated by the user only once, the actuator may open and close the valve for a plurality of times. It is thereby further possible, that the actuator will still displace, i.e., open and close the valve for some additional times, even if the trigger device is not operated anymore by the user.

The electromechanical actuator may be a linear actuator, for example. But the actuator may also be of any other kind of actuators, for example a rotary actuator. When using a rotary actuator a mechanical transmitting device may be provided for connecting the rotary actuator with the valve, preferably with the valve body. Last mentioned transmitting device may be used to change a rotary movement into a translational movement for example.

In particular, the actuator may include a solenoid actuator and preferably a return spring. A solenoid actuator can be provided and configured to displace the valve body of the valve. For example, the actuator may be configured to apply a force to the valve body, which force shifts the valve body of the valve from a closed position into an open position. In the closed position a fluid connection of the valve seat is blocked by the valve member, whereas in the open position the valve member is retracted from valve seat thereby freeing the fluid connection of the valve seat. In addition, a return spring may be biased by shifting the valve member from the closed position into the open position of the valve member, i.e. the return spring is configured to remove the valve body from an opened position into an closed position after the force being provided by the solenoid actuator is reduced below a threshold, which is smaller than the force being introduced by the return spring.

According to a third feature of the present invention the above-mentioned object is achieved by a water gun that includes at least one of: a supply line, which is adapted to supply pressurized liquid from a source, a nozzle arrangement for ejecting the liquid to the environment, a flow smoothing device, adapted for smoothing a flow of the pressurized liquid, a valve for controlling the flow of the pressurized liquid in a flow direction from the supply line to the nozzle arrangement, and a trigger device, which is adapted to control the valve for ejecting a shot of a laminar jet of liquid, wherein the valve is in an opened state for a period of time smaller than 100 ms, preferably of smaller than 50 ms or/and has an valve opening movement time smaller than 60 ms, preferably smaller than 30 ms during the shot (that is, during the time the valve is open). Due to this aspect of the present invention it is possible that liquid ejected out of the water gun (when the trigger device is operated), assumes a shape of a laminar jet of liquid i.e. a shape of a compact liquid jet that is similar to a projectile of a determined size. By virtue of a combined effect of the smoothing device and the very fast-operating valve control, an amount of liquid is ejected out of the nozzle arrangement in such a manner as to generate a laminar jet of liquid with improved flight characteristics as well as improved stability, and thus an extended range combined with a better target accuracy of the water gun can be achieved. Alternatively or additionally, the valve has an opening movement time smaller than 60 ms, preferably smaller than 30 ms during the shot. This opening movement time describes the period of time, which is needed to move the valve from a closed position to an opened position, in which position the valve remains for a determined duration of time. To achieve a compact jet of liquid upon ejecting a single shot it is highly preferred to ensure an opening time, which is sufficiently short, i.e. fast enough, to create a clearly defined and compact jet of ejected liquid.

According to a particularly preferred embodiment of the invention, the valve is in an opened state for a period of time smaller than 40 ms, more preferably of smaller than 20 ms or/and has an valve opening movement time smaller than 25 ms, more preferably smaller than 10 ms during the shot. For a further improvement of the shot behavior of the water gun it is preferable that the valve is in an opened state for a period of time smaller than 40 ms or/and has an valve opening movement time smaller than 25 ms. To achieve a water gun of very high performance, which have a particular high range or/and a particular high target accuracy, it is further preferred that the valve is in an opened state for a period of time smaller than 20 ms or/and has an valve opening movement time smaller than 10 ms.

Preferably, the valve may have a closing movement time (the time required to move the valve from the opened position to the closed position) shorter than 80 ms, preferably shorter than 40 ms. In addition to the above mentioned characteristics it is preferable for the valve even to have a sufficiently short—i.e. fast enough closing movement time, which is necessary to provide a creation of a defined end (end means the rear side of the laminar jet of liquid seen in the shooting direction S, described later) of the laminar jet of liquid so as to achieve the above mentioned compact shape which ensures said flight characteristics as well as an improved stability of the ejected liquid.

Further, the trigger arrangement may include an electrical trigger or/and an electrical push-button or/and a magnet, which is operatively connected to a Hall-effect sensor. Such electrical trigger is adapted to detect when it is being pushed or pulled or pressed by a person using the water gun to eject one or more laminar jets of liquid. An operation of the electrical trigger causes the valve to be displaced (i.e. opened and closed) in such a manner that one or more laminar jets of liquid are ejected out of the water gun. This can be achieved, for example, by an electrical push-button being operated by the user of the water gun. But it is also possible to use further types of electrical triggers, preferably liquid-proofed triggers etc. In addition or as an alternative, the trigger arrangement may include a magnet, which is operatively connected to a hall-effect sensor. Accordingly, it is conceivable that the magnet is positioned, e.g. in a manner facing the hall-effect sensor, that it will be moved in relation to the hall-effect sensor if the using person wants to eject one or more shots of liquid, whereas in turn the hall-effect sensor is positioned such that it detects the change in the position of the magnet in relation to the hall-effect sensor via measuring the change of the magnetic field (in particular of the magnetic flux density). As a result, the hall-effect sensor may provide an electric signal depending on said measured magnetic flux density, which electrical signal represents a shot intention of the user.

It is preferable for the water gun that upon a single operation of the electrical trigger either a predetermined plural number of laminar jets of liquid are ejected from the water gun independently from an operation duration or a single laminar jet of liquid with a jet duration that is independent from the duration of the single operation of the trigger. In other words, the water gun may have an operating state such as a single or burst shot mode, which operating state can be selected by the user for example by a switch being mounted at a housing of the water gun.

Alternatively or additionally, it is preferable for the water gun that upon a single operation of the electrical trigger a plurality of laminar jets of liquid is ejected from the water gun depending on the duration of operation. In other words, the water gun may have an operating state such as an auto fire mode, which operating state can be selected by the user for example by the above-mentioned switch being mounted at the housing of the water gun.

According to a preferred embodiment of the present invention, the trigger device includes a locking mechanism adapted for the valve being opened in a sudden, intermittent manner after unlocking the locking mechanism (after the locking mechanism has been unlocked) to realize valve opening and closing times in the ms-range. To further reduce the opening movement time of the valve, a mechanical locking mechanism is provided, which is configured to suddenly, abruptly, swiftly release the valve movement when a predetermined condition is achieved. This condition can be a predetermined stroke or angle as well as a force or a torque induced by an actuator or the like.

According to a fourth aspect of the present invention, the above mentioned object is achieved by a water gun that includes at least one of: a storage device for storing pressurized liquid, a nozzle arrangement for ejecting the liquid to the environment, a valve for controlling a flow of the pressurized liquid in a flow direction from the storage device to the nozzle arrangement, and a trigger device that is adapted to control the valve, where the water gun comprises an indicator, for example some indicating means such as for example an electronic display or an generator of an audible signal. The indicator is adapted to indicate a number of triggering procedures of the valve (a number of times the valve has been triggered). As an enhancement to water guns as known from the prior art it is possible to indicate the number of triggering procedures of the valve via an indicator. In other words, not only a pressure or a volume being present in the storage device or a degree to which the storage device is filled is indicated, but also a number of shots such that the user receives information about a number of shots, which can be still ejected or an information about a number of shots, which have been already ejected out of the water gun. In more detail, when operating the trigger device, the number of triggering procedures of the valve indicated by the indicator may increase or decrease by an integer value. Therefore, in particular, the further object of the invention is achieved to provide a water gun with improved usability.

It is preferable for the water gun that the indicated number is associated with the volume of liquid present in the storage device. Since the quantity of liquid ejected during a single shot is substantially constant and the volume present in the totally filled storage device is known, it is possible to calculate a number of shots that are associated with the volume of liquid in the storage device. The calculation may be performed by an electronic control unit or circuitry or the like. In result, the user has the possibility to receive accurate information about the current filling state of the storage device and is able to decide whether or not a filling procedure is necessary.

According to a further embodiment, the water gun may be further adapted to only trigger the valve when the storage device contains a sufficient volume of liquid and not to trigger the valve if the storage device is empty or/and if the volume of liquid present in the storage device lies under a predetermined minimum volume. According to the latter, the water gun does not trigger the valve without ejecting a shot of liquid.

Preferably, the indicator may further include an electronic display. By the use of said electronic display it is possible to indicate additional information associated with and/or representing the water gun which can be received by the user, for example a current loading state of a battery or a current operating state of the water gun etc. The electronical display may also include an illuminating means, e.g. a light source, to ensure clear readability even under disadvantageous lighting conditions, for example during a use of said water gun at night or in dark buildings or rooms etc.

According to a preferred embodiment, the storage device may include a sensor, which is adapted to determine the volume of liquid present in the storage device. As a result, in the operational enhancement is provided in that the number shots of liquid present in the storage device can be exactly displayed by the indicator even if the storage device is not filled up completely during the filling process. This effect is achieved since the number of remaining shots is calculated from the volume being present in the storage device and not from a preset value that is associated with (or represents) a volume of the storage device being in a state fully filled.

It is preferable for the sensor to include a feeler (a sensor) or/and preferably a light barrier. With such feeler (sensor) and/or such light barrier it can be achieved to measure an extension of, for example, a flexible bladder disposed within the storage device and containing the pressurized liquid. Due to the fact that the extension of the flexible bladder relates to the volume of pressurized liquid present in the storage device, such volume of pressurized liquid can be calculated.

According to the above-mentioned first to fourth aspects of the present invention it may be preferred that the water gun further includes a flow smoothing device, which device is adapted for smoothing a flow of pressurized liquid, wherein the valve for controlling the flow of the liquid in a flow direction from the supply line to the nozzle arrangement is arranged upstream the flow smoothing device, i.e. in front of the flow smoothing device, with respect to a shot direction of the water gun. This arrangement of the valve and the flow smoothing device is known from prior art water guns and has shown satisfactory results along with a good price-performance ratio.

According to a fifth aspect of the present invention the above-mentioned object is achieved by a water gun that includes at least one of: a supply line, which is adapted to supply pressurized liquid from a source, a nozzle arrangement for ejecting liquid to the environment, a flow smoothing device, adapted for smoothing a flow of the pressurized liquid, and a valve for controlling the flow of the liquid in a flow direction from the supply line to the nozzle arrangement, wherein the valve is arranged behind the smoothing device with respect to the flow direction, in other words, the valve is arranged downstream of the smoothing device with respect to a shot direction of the water gun (for example the shot direction S, described later). The flow smoothing device, which is adapted for smoothing a flow of pressurized liquid, causes a damping of turbulences within said flow i.e. it ensures that the flow being ejected out of the nozzle arrangement is substantially laminar. For this reason, a flow ejected out of the water gun, for example a water jet of a certain length, may have improved flight characteristics as well as an improved stability and thus an extended range combined with a better target accuracy can be achieved. It should be mentioned, that in this context said flow direction means a path of movement of the liquid and may not be necessarily a linear direction.

The flow smoothing device may have a plurality of channels being parallel to the flow direction. These channels may have a cross-section being a circular shape for example. But it is also possible for the cross-section of the channels to be a polygonal or an ellipsoidal shape or the like. In particular, the plurality of channels may have a function of smoothing the flow of pressurized liquid when flowing through the flow smoothing device. As a result, the flight characteristics, e.g., the stability of the ejected liquid, for example a waterjet of a certain length, can be further improved.

The flow smoothing device may have an effective length of at least 40 mm, preferably of at least 70 mm along the flow direction. Further the flow smoothing device may have an effective flow cross section (sum of surface areas of all channels) of at least 500 square millimeters, preferably an effective flow cross section of at least 1500 square millimeters. Due to setting the length or/and the cross section of the flow smoothing device and thus the effective volume of the flow smoothing device within a certain range the effect of the flow smoothing device will be further enhanced.

According to a further embodiment of the present invention, the flow smoothing device may have different portions such as a rectifier and a calming zone. Herein the rectifier may have the function to reduce turbulence within said flow. The calming zone may have empty spaces for calming the liquid. It is therefore possible to achieve an even more laminar flow of pressurized liquid since the pressurized liquid has to pass through a rectifier as a well as a calming zone and thereby the flight characteristics of the ejected liquid can be further improved.

According to a preferred embodiment of the present invention, the flow smoothing device may include a baffle plate or/and a filtering foam. The baffle plate may be produced from metal or plastic material etc. and has a plurality of openings which may be a circular or a polygonal shape. A filtering foam, which may be provided additionally or alternatively, has a porous structure and may be produced from a material having filtering characteristics, for example from a synthetic material. Since the flow of pressurized liquid has to pass the baffle plate or/and the filtering foam the flow velocity will be reduced and the effect of the flow smoothing device can be further improved.

It should be mentioned that according to the present invention a combination of all above-mentioned aspects may be possible.

BRIEF DESCRIPTION OF THE DRAWINGS

In the following, the invention will be described by way of examples, without limitation of the general inventive concept, of embodiments and with reference to the drawings. Referring to the drawings, further characteristics and advantages of the present invention will be described as follows.

FIG. 1 shows a cross-sectional view according to a first embodiment of the present invention.

While the invention may be variously modified and assume alternative forms, specific embodiments thereof are shown by way of example in the drawings and will herein be described in detail. It should be understood, however, that the drawings and related detailed description are not intended to limit the invention to the particular form disclosed, but to the contrary, the intention is intended to cover all modifications, equivalents and alternatives falling within the spirit and scope of the present invention as defined by the appended claims.

DETAILED DESCRIPTION

As shown in FIG. 1 a water gun 1 according to the first embodiment of the present invention may include a flow smoothing device 10 arranged within a housing 11, adapted for smoothing a flow of pressurized liquid (not illustrated), which flows through the flow smoothing device 10 in a shot direction S. Said shot direction S describes the flight direction of liquid which is ejected out of the water gun 1. The flow smoothing device 10 may be supplied with pressurized liquid from a source, which may be for example a storage device 60, described later, via a supply line 77. The flow smoothing device 10 may include one or more rectifiers 12 having a plurality of channels being parallel to the shot direction S. Upstream to or between these rectifiers 12 the flow smoothing device 10 may include calming zones 14, which may be empty spaces, for calming the flow of pressurized liquid before flowing into the rectifiers 12. The flow smoothing device 10 may further include a filtering foam 16 or/and a baffle plate 18, which are arranged upstream to the calming zones 14 and the rectifiers 12. In addition, the flow smoothing device 10 may include a wire mesh 20 having a plurality of small openings through which the pressurized liquid will be pressed as well as a guiding structure 22 described later.

According to the present embodiment the water gun 1 further includes a valve 24 including a valve body 28 and a valve seat 26, where the valve seat 26 and the valve body 28 are attachable in a sealing manner such that the flow of pressurized liquid ejected out of the water gun through a nozzle arrangement 29 can be controlled (that is, the valve can be opened or closed). The valve body 28 is linked with a rod 30, preferably extending parallel to the shot direction S. The rod 30 is extends centralized along the main axis of the flow smoothing device 10 and is guided by said guiding structure 22 so as to be displaceable in a translational manner along the shot direction S. The rod 30 may be further linked with a locking mechanism 32, described later, and additionally with a spring 34, which is linked with an electromechanical actuator 38 via a second rod 36. Said actuator 38 may include a solenoid 40 with an armature 42 as well as preferably a return spring 44. A movement of the actuator 38 in particular a movement of the armature 42 from an initial position along a direction opposite to the shot direction S (as indicated in FIG. 1 by an arrow in vicinity of said armature 42 will cause an equivalent movement of an unlocking member 35 being linked with the second rod 36. As a result, the spring 34 will be tensioned since the movement of the rod 30 is suppressed due to the locking mechanism 32. (A locking mechanism is, therefore, configured to releasably block the rod in its initial position to prevent the rod from moving.) At the same time as the unlocking member 35 moves further along said direction opposite to the shot direction S, the unlocking member 35 will cause a rotation of the locking mechanism 32 such that the locking mechanism of the rod 30 will be unlocked and subsequently the spring 34 relaxes in a jerky, sudden, abrupt manner. As a result said rod 30 and the valve body 28 will be displaced in a translational direction, i.e. shifted opposite to the shot direction S, thereby opening the valve 24. The liquid will be ejected out of the water gun 1 along the shot direction S. Subsequently, after the force due to the current through the solenoid 40 decreases, the return spring 44 will shift the armature 42 back into its initial position. Thereby the valve body 28 is moved back in the position blocking the valve seat 26 in a sealing manner, again. At the same time the ejection of liquid into the environment will be stopped.

Said actuator 38 may be supplied by an electrical energy storage 46, which may be also arranged within the housing 11. Additionally, the electrical energy storage 46 may include an electrical connector 48 which is adapted to link the electrical energy storage 46 with an electrical energy source (not illustrated) for charging.

As shown in FIG. 1 the water gun 1 may include a trigger device 50, which is adapted to control the valve 24 for ejecting a quantity of liquid, preferably a shot of a laminar jet of liquid. In addition, the trigger device 50 may include an electrical trigger 52 which is connected to an electrical control unit 58 (hereinafter "ECU"). According to the present embodiment, the trigger device 50 includes an additional trigger 54, which is adapted to be operated by a user. This trigger 54 may be any type of, preferably liquid-proofed, triggers such as touch sensitive or force sensitive triggers.

Upon operation of the trigger 54 the ECU 58 will cause the actuator 38 to actuate respectively to open the valve for ejecting the liquid to the environment. Herein the water gun 1 may further include a switch 56, which is adapted to change an operating state of the water gun 1. In more detail the water gun 1 may have operating states like a "single" or "burst shot mode", which can be selected by the user for example via operating the switch 56. In addition, the water gun 1 may have an operating state like an "auto fire mode", which can be also selected with said switch 56 being mounted at the housing of the water gun 1. Alternatively, it is also possible to select the operating state of the water gun 1 by an external electronic device (not illustrated) which is connected with the ECU 58 in a communicating manner.

The water gun 1 may further include the storage device 60 for storing pressurized liquid. Herein the storage device 60 may include a flexible bladder 62 which is adapted to contain pressurized liquid. The storage device 60 is a preferred embodiment of a pressurized liquid source. Said flexible bladder 62 may be enclosed by a rigid housing 64. At one end of the flexible bladder 62 there may be provided a plug 66 which is adapted to seal this end of the flexible bladder 62. Last-mentioned plug 66 may further include a valve 68, which is provided to allow air being inside the flexible bladder 62 to escape when filling the flexible bladder 62 with liquid. The one end of the flexible bladder 62 is further fixed on a guiding unit 70, which allows said end to move in a translational manner along the guiding walls of the rigid housing 64.

According to the present embodiment of the invention the water gun 1 may further include a handle portion 72, which is adapted for gripping the water gun 1 by a user and a nozzle portion 74 facing away from the handle portion 72 with the nozzle arrangement 29 for ejecting the liquid. In addition, the water gun 1 includes a liquid inlet 76, which is arranged within the nozzle portion 74 and a pump device 78 for supplying liquid from outside the water gun 1 via the liquid inlet 76 into the storage device 60. Herein the water gun 1 may further include a sensor 80 arranged in the nozzle portion 74 or adjacent the nozzle portion 74, which is adapted to detect whether or not the nozzle portion 74 is in contact with a liquid and to subsequently activate the pump device 78 via the ECU 58 for filling the storage device 60. Herein the liquid inlet 76 may be connected with the storage device 60 via the supply line 77. In addition, said liquid inlet 76 may include a filter, preferably a sieve, to prevent foreign matter to be suctioned into the water gun 1 by the pump device 78. Additionally, the storage device 60 may include a sensor 82, which is adapted to detect whether the flexible bladder 62 is completely extended such that the storage device 60 is fully filled and subsequently causes to deactivate the pump device 78 by the ECU 58.

As further shown in FIG. 1, the water gun 1 may include an indicator 84, which is adapted to indicate a number of triggering procedures of the valve 24. In more detail, a number of single shots of liquid is indicated such that the user receives information about a number of shots which could be ejected or an information about a number of shots already ejected out of the water gun 1. Upon an operation of the trigger device 50 the number of triggering procedures of the valve being indicated by the indicator 84 may increase or decrease by an integer value.

Preferably, the indicator 84 may further include an electronic display. By the use of said electronic display it is possible to indicate additional information being associated with the water gun 1 which can be received by the user, for example a current loading state of the electrical energy storage 46 or the current operating state of the water gun 1 etc. The electronic display may also include an illuminating means, e.g. a light source, to ensure clear readability even under disadvantageous lighting conditions, for example during a use of said water gun at night or in dark buildings or rooms etc.

According to a preferred embodiment, the sensor 82 is adapted to determine the volume of liquid present in the storage device 60. It is herein preferable for the sensor 82 to include a feeler (a sensor) or/and preferably a light barrier. It is thereby possible that the volume of liquid present in the storage device 60 can be exactly indicated by the indicator 84 even if the storage device is not filled up completely during the filling process. This effect is achieved since the number of remaining shots is calculated by the ECU 58 depending on the volume being present in the storage device 60.

It is preferable for the sensor 82 to include a feeler or/and preferably a light barrier. With said feeler and/or said light barrier it can be achieved to measure an extension of for example a flexible bladder being arranged within the storage device and containing the pressurized liquid. Due to the fact that the extension of the flexible bladder relates to the volume of pressurized liquid being present in the storage device said volume of pressurized liquid can be calculated.

According to a second not shown embodiment of the water gun it is suggested that the flow smoothing device is arranged behind the valve with respect to the shot direction S of the water gun.

It will be appreciated to those skilled in the art having the benefit of this disclosure that this invention is believed to provide a water gun. Further modifications and alternative embodiments of various aspects of the invention will be apparent to those skilled in the art in view of this description. Accordingly, this description is to be construed as illustrative only and is provided for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A water gun comprising:
a pressurized liquid source,
a supply line,
a valve,
a nozzle arrangement,
wherein:
the supply line fluidly connects the pressurized liquid source with the valve,
the nozzle arrangement is configured to eject liquid from the pressurized liquid source to an environment,
the valve is positioned in between the supply line and the nozzle arrangement and is configured to control a flow of the liquid from the pressurized liquid source in a flow direction from the supply line to the nozzle arrangement,
the valve includes a valve seat and a movably-supported valve body, the valve body having a first position, in which the valve body attaches to the valve seat in a sealing manner,
an electromechanical actuator coupled with the valve body and configured to displace the valve body substantially parallel to the flow direction into a second position,
a handle portion configured to grip the water gun,
a nozzle portion disposed to face away from the handle portion and including the nozzle arrangement, and
a pump device that includes
(a) a pump inlet in fluid communication with a liquid inlet of the water gun and
(b) a pump outlet in fluid communication with the pressurized liquid source, wherein the liquid inlet is arranged in the nozzle portion or adjacent to the nozzle portion.

2. The water gun of claim 1, wherein the valve body has a first dimension along the flow direction, a second dimension perpendicularly to the flow direction, and wherein the first dimension exceeds second dimension.

3. The water gun of claim 2, wherein the valve body has an ellipsoidal shape or a torpedo-like shape.

4. The water gun of claim 1,
wherein the electromechanical actuator comprises a solenoid and an armature positioned to be moved, from an initial position along a direction opposite to the flow direction, by a magnetic field generated by an electrical current when said current flows through the solenoid,
wherein the armature is coupled with the valve body and thereby is configured to displace the valve body in the direction opposite to the flow direction.

5. The water gun of claim 4, wherein the actuator comprises a return spring positioned to be loaded by a movement of the armature in the direction opposite to the flow direction.

6. The water gun of claim 4, further comprising
a first rod attached to the valve body,
a locking mechanism configured to releasably block the first rod in a first rod's initial position to prevent a movement of the first rod,
an auxiliary spring attached to the first rod and connected to the armature via a second rod,
an unlocking member connected to the second rod and configured to release the locking mechanism when potential energy stored in the auxiliary spring exceeds a threshold value.

7. The water gun according to claim 1, further comprising a trigger device configured to control the electromechanical actuator.

8. The water gun of claim 7, wherein the trigger device includes at least one of an electrical trigger, an electrical push-button, and a magnet that is operably connected to a Hall-effect sensor.

9. The water gun of claim 8, configured to eject, upon a single occurrence of operation of the electrical trigger, either a predetermined plural number of spatially-separated laminar jets of liquid independently from a duration of said single occurrence of operation or a single laminar jet of said liquid having a jet duration that is independent from the duration of said single occurrence.

10. The water gun of claim 9, wherein the electromechanical actuator is configured to open and close the valve for a number of additional times after an initial operation of the trigger device, when the trigger device is no longer operated by a user.

11. A water gun comprising:
a pressurized liquid source,
a supply line,
a valve,
a nozzle arrangement,
wherein:
the supply line fluidly connects the pressurized liquid source with the valve,
the nozzle arrangement is configured to eject liquid from the pressurized liquid source to an environment,
the valve is positioned in between the supply line and the nozzle arrangement and is configured to control a flow of the liquid from the pressurized liquid source in a flow direction from the supply line to the nozzle arrangement,
the valve includes a valve seat and a movably-supported valve body, the valve body having a first position, in which the valve body attaches to the valve seat in a sealing manner,
an electromechanical actuator coupled with the valve body and configured to displace the valve body substantially parallel to the flow direction into a second position,
a trigger device configured to control the actuator,
an indicator configured to indicate a number of triggering procedures of the valve.

12. The water gun according to claim 11, wherein a number indicated by the indicator is associated with a volume of liquid present in the pressurized liquid source.

13. A water gun comprising:
a pressurized liquid source,
a supply line,
a valve,
a nozzle arrangement,
wherein:
the supply line fluidly connects the pressurized liquid source with the valve, the nozzle arrangement is configured to eject liquid from the pressurized liquid source to an environment, the valve is positioned in between the supply line and the nozzle arrangement and is configured to control a flow of the liquid from the pressurized liquid source in a flow direction from the supply line to the nozzle arrangement, the valve includes a valve seat and a movably-supported valve body, the valve body having a first position, in which the valve body attaches to the valve seat in a sealing manner, an electromechanical actuator coupled with the valve body and configured to displace the valve body substantially parallel to the flow direction into a second position, wherein the pressurized liquid source includes a sensor, and wherein the sensor is configured to determine a volume of liquid present in the pressurized liquid source.

14. The water gun of claim 13, which the sensor includes at least one of a feeler and a light barrier.

15. The water gun of claim 1, further comprising:

a liquid sensor arranged in the nozzle portion, the liquid sensor configured to detect an activation condition of the pump device and to subsequently activate the pump device to fill the pressurized liquid source.

16. A water gun comprising:

a pressurized liquid source, a supply line, a valve, a nozzle arrangement, wherein:

the supply line fluidly connects the pressurized liquid source with the valve, the nozzle arrangement is configured to eject liquid from the pressurized liquid source to an environment, the valve is positioned in between the supply line and the nozzle arrangement and is configured to control a flow of the liquid from the pressurized liquid source in a flow direction from the supply line to the nozzle arrangement, the valve includes a valve seat and a movably-supported valve body, the valve body having a first position, in which the valve body attaches to the valve seat in a sealing manner, an electromechanical actuator coupled with the valve body and configured to displace the valve body substantially parallel to the flow direction into a second position, wherein the electromechanical actuator comprises a solenoid and an armature positioned to be moved, from an initial position along a direction opposite to the flow direction, by a magnetic field generated by an electrical current when said current flows through the solenoid, wherein the armature is coupled with the valve body and thereby configured to displace the valve body in the direction opposite to the flow direction, a first rod attached to the valve body, a locking mechanism configured to releasably block the first rod in a first rod's initial position to prevent a movement of the first rod, an auxiliary spring attached to the first rod and connected to the armature via a second rod, and an unlocking member connected to the second rod and configured to release the locking mechanism when potential energy stored in the auxiliary spring exceeds a threshold value.

* * * * *